US006055296A

United States Patent [19]

Ferlic et al.

[11] Patent Number: 6,055,296

[45] Date of Patent: Apr. 25, 2000

[54] RADIOGRAPHIC GRID WITH REDUCED LAMELLAE DENSITY ARTIFACTS

[76] Inventors: Daniel J. Ferlic, 406 Birchwood Ave., White Bear Lake, Minn. 55110; Randolph M. Ferlic, 40025 Paseo Entrada, P.O. Box 5005, Rancho Mirage, Calif. 92270

[21] Appl. No.: 09/023,678

[22] Filed: Feb. 13, 1998

Related U.S. Application Data

[63] Continuation-in-part of application No. 08/718,249, Sep. 20, 1996, Pat. No. 5,721,761.

[51] Int. Cl.[7] ..... G21K 1/00

[52] U.S. Cl. ..... 378/154; 378/145

[58] Field of Search ..... 378/154, 155

[56] References Cited

U.S. PATENT DOCUMENTS 5,606,589 2/1997 Pellegrino et al. ..... 378/154

*Primary Examiner*—Craig E. Church
*Attorney, Agent, or Firm*—Kinney & Lange, P.A.

[57] ABSTRACT

A radiographic grid with reduced line density artifacts. The radiographic grid includes a grid housing sized to receive a plurality of x-ray radiation absorbing lamellae. Each of the plurality of lamellae has a foil strip applied to its lower end portion. The foil eliminates the lamella line artifacts otherwise emanating from the lamellae.

4 Claims, 9 Drawing Sheets

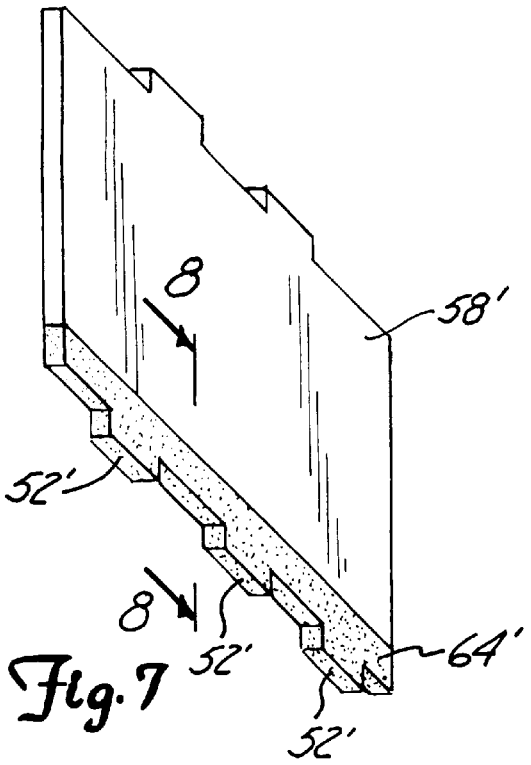
Fig. 7
Fig. 8
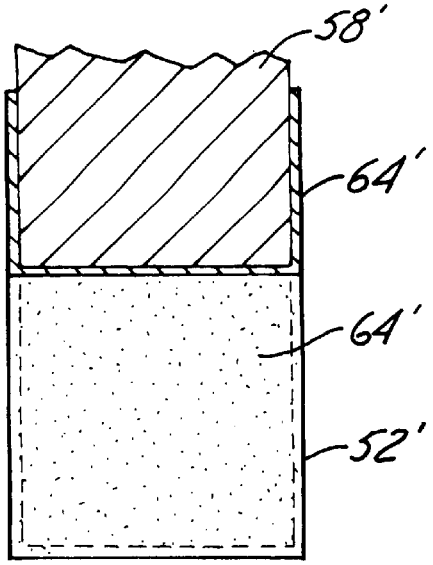

RADIOGRAPHIC GRID WITH REDUCED LAMELLAE DENSITY ARTIFACTS

REFERENCE TO RELATED APPLICATION

This application is a continuation-in-part of Ser. No. 08/718,249 filed Sep. 20, 1996 now U.S. Pat. No. 5,721,761.

BACKGROUND OF THE INVENTION

The present invention relates to an improved radiographic grid for use in an x-ray apparatus, especially for use in an x-ray mammography apparatus. More particularly, it relates to a radiographic grid having foil disposed about individual lamella for reducing lamellae density artifacts.

It has been well known since the early days of radiography that secondary or scattered x-rays reduce the contrast of an x-ray image. The low difference in x-ray absorption characteristics between cancerous and non-cancerous tissue has made mammography particularly susceptible to imaging problems caused by scattered radiation. A conventional Bucky grid, consisting of a series of lead foil strips separated by strips of x-ray semi-transparent spacers, helps remove scattered radiation from radiographic fields.

The thin strips of x-ray radiation absorbing material are called lamellae and are substantially aligned with the incident course of the radiation from the x-ray source, with the x-rays being transmitted through the gaps between the lamellae. The grid is positioned between the object being analyzed and the image receptor (or film) to reduce scattered radiation, thereby improving image contrast on the film.

Radiographic grids have been subject to various recent improvements. For example, U.S. Pat. No. 4,901,335 to Ferlic et al. teaches a reciprocating grid having at least a 90% open area at all positions of travel to transmission of directly incident x-ray radiation (i.e. radiation perpendicular to the tangent of the direction of travel of the grid at the point of incidence). The lamellae are individually positioned and aligned with respect to each other in a grid housing and then a cover sheet, substantially covered with an adhesive, is pressed down onto the edges of the lamellae.

Radiographic grids have proved to be a highly useful tool for removing scattered radiation from radiographic fields. However, it can be demonstrated that x-ray images produced with radiographic grids contain a "straight line" density artifact apparently associated with the lamellae. These lines correspond to the distance between individual lamella. Obviously, these line-shaped densities are undesirable as the goal with mammography or any other x-ray application is to eliminate all density related noise so that the resulting image is a true depiction of the patient's status.

Primary radiation is orientated in the same axis as the lamellae and passes between them to reach the film. Scattered radiation arises from many points within the patient, and is multidirectional, so that most of it is absorbed by the lamellae, and only a small amount passes between them. The lamellae line artifacts are not characteristic of prim or scattered radiation, but rather are subsequent to secondary radiation. The lamellae line artifacts are analogous to either a wave or a tertiary radiation.

The lamellae line artifacts appear resultant from or subsequent to the scattered radiation and are likely an additional emission from the lead or metal based lamellae. The basis for concluding that the lamellae line artifacts are tertiary radiation or wave-related is due to the observation that the lamellae emission which produces the density artifact occurs subsequent or resultant to the secondary radiation. Further, tests have shown that the emission appears to occur only in a downward direction (with respect to the position of the grid) as the lamellae line artifact does not materialize on film placed above the grid. Finally, tests have demonstrated that the line artifact is orientated with respect to the central ray of the x-ray source. In other words, the density line artifact is produced on the left side of lamellae positioned on the far right side of the film. Conversely, the line artifact density is produced on the right side of the lamellae positioned to the far left side of the film.

Regardless of whether the artifact originates from a third order energy source, this density, like all other densities associated with radiographic grids, should be eliminated. Little research has been done to find a solution. In fact, a search of standard references revealed no literature describing the effect.

A substantial need exists for a radiographic grid apparatus which eliminates the recently identified lamellae line artifact.

SUMMARY OF THE INVENTION

The present invention provides a radiographic grid configured to reduce or eliminate lamellae line density artifacts. The radiographic grid includes a grid housing and a plurality of x-ray radiation absorbing lamellae disposed within the grid housing. The ends of the lamallae furthest from the x-ray source are coated with a thin metal foil which acts to reduce the lamellae line density artifact otherwise found on the x-ray image.

BRIEF DESCRIPTION OF THE DRAWINGS

FIG. 7 is a perspective view of a lamella with its lower end portion coated with a thin metal foil in accordance with the present invention.

FIG. 8 is a sectional view along section 8—8 of FIG. 7.

DETAILED DESCRIPTION OF THE PREFERRED EMBODIMENTS

Figure 1:
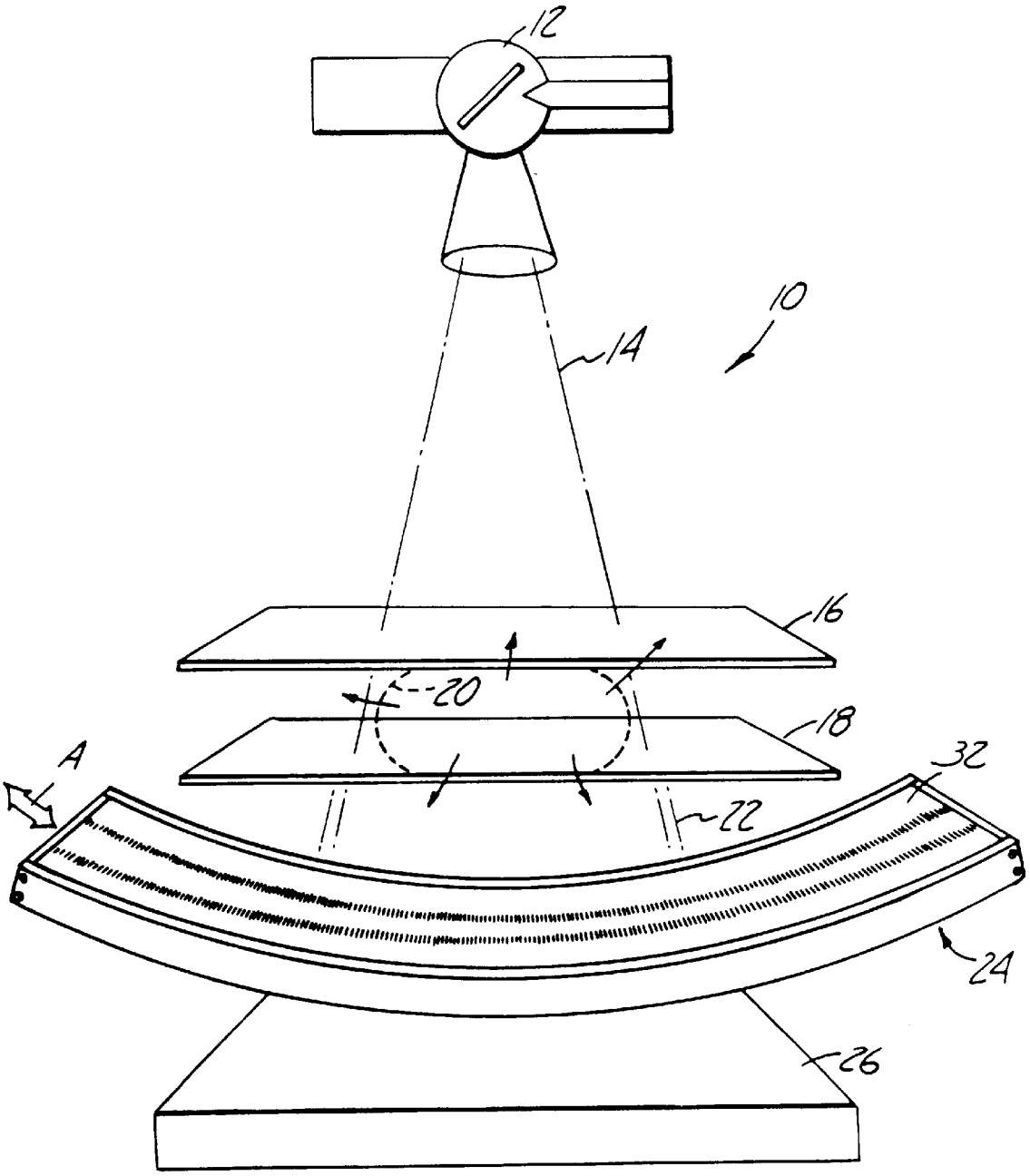
FIG. 1 is a perspective view of a mammography apparatus utilizing a radiographic grid in accordance with the present invention.

FIG. 1 illustrates a schematic arrangement of a mammography apparatus 10. An x-ray source 12 emits a cone-shaped x-ray beam 14 towards the mammography apparatus 10. An upper compression plate 16 and a lower compression plate 18 compress a woman's breast 20 (shown in hatching). In this position, the breast 20 is exposed to the incident x-ray beam 14. The x-ray beam 14 is shaped by an operator (not shown) as required to fully illuminate the breast 20, but ideally does not extend beyond an outer diameter of the breast 20. Resulting scattered x-rays from the breast 20 are indicated by arrows 22.

The upper compression plate 16 and the lower compression plate 18 are formed from polyester sheets having a thickness of 0.1778 mm. The upper compression plate 16 and the lower compression plate 18 generate little secondary radiation and exhibit negligible scattered radiation. A reciprocating radiographic grid 24 is disposed between the lower compression plate 18 and a film/screen cassette 26 for preventing transmission of scattered x-ray radiation to the film/screen cassette 26. The radiographic grid 24 and the film/screen cassette 26 are positioned closely to the lower compression plate 18 to minimize magnification effects. The radiographic grid 24 has a reciprocating travel indicated by double headed arrow "A" and as fully described in U.S. Pat. No. 4,901,335. Radiographic grids are taught more fully by U.S. Pat. No. 4,901,335, which is incorporated herein by reference.

Figure 2:
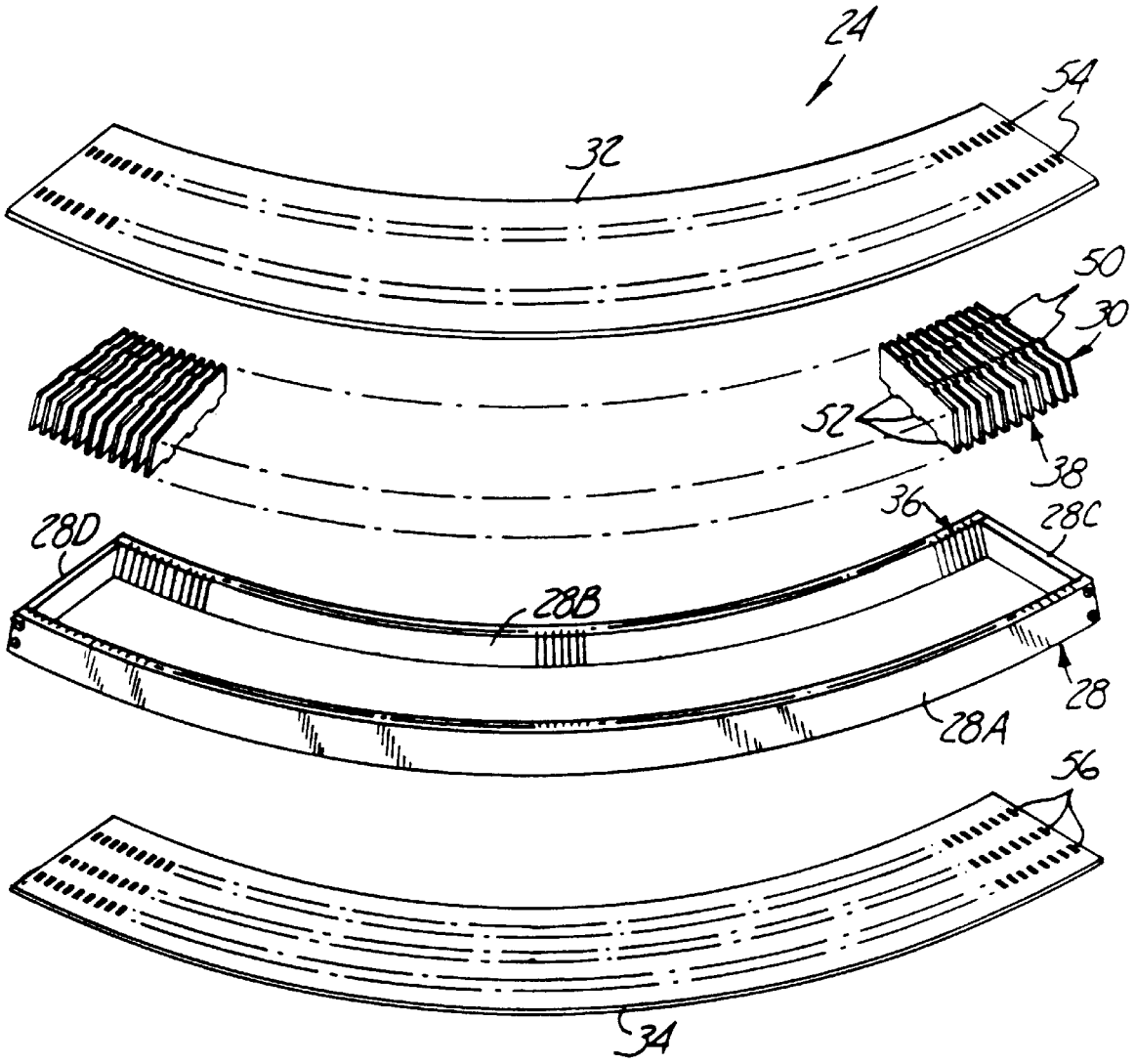
FIG. 2 is an exploded perspective view of the radiographic grid in accordance with the present invention.

Generally speaking, and as shown in FIG. 2, the radiographic grid 24 includes a grid housing 28, a plurality of x-ray radiation absorbing lamellae 30 disposed in the grid housing 28, a top polymeric sheet 32 sealing an upper side of the grid housing 28 and a bottom polymeric sheet 34 sealing a lower side of the grid housing 28.

The grid housing 28 includes a first side wall 28A, a second side wall 28B, a front wall 28C and a back wall 28D. The side walls 28A and 28B each include a plurality of longitudinal slots 36 therein, facing an interior of the grid housing 28 and corresponding to the number of the plurality of lamellae 30. The side walls 28A and 28B are preferably arc-shaped or bent along a circumference of a desired cylindrical section for the radiographic grid 24. The longitudinal slots 36 are positioned on the side walls 28A and 28B such that the plurality of lamellae 30, when inserted therebetween, are focused to a convergent line at the x-ray radiation source (12 in FIG. 1) spaced above the radiographic grid 24.

Each of the plurality of lamellae 30 are typically lead strips having a thickness between 0.075 mm and 0.25 mm. However, other metals can be used. As described in greater detail below, each of the plurality of lamellae 30 has a thin foil strip (not shown) applied to its outer walls as shown in (FIG. 3) or applied to its lower end portions (as shown in FIGS. 7 and 8). The plurality of lamellae 30 are placed in the longitudinal slots 36 along the length of the side walls 28A and 28B. Between each of the plurality of lamellae 30 is an air gap or slot 38. The ratio of the height of each of the slots 38 (i.e. the height of each of the plurality of lamellae 30) to its width (i.e. the distance between each of the plurality of lamellae 30) is preferable a minimum of 5:1 and is potentially as large as 30:1. Each of the plurality of lamellae 30 have a preferred height of 3 to 20 mm.

The top polymeric sheet 32 and the bottom polymeric sheet 34 have a thickness preferably between 0.0225 and 0.127 mm. The polymeric sheets 32 and 34 are preferably made of a mylar material. However, any other type of flexible, dimensionally stable plastic is equally acceptable. Finally, both of the top polymeric sheet 32 and the bottom polymeric sheet 34 have an adhesive along a peripheral border thereof for application of the polymeric sheet 32 or 34 to the grid housing 28.

As an aide for alignment, and as shown in FIG. 2, the plurality of lamellae 30 preferably include top tabs 50 and bottom tabs 52. The top polymeric sheet 32 includes slits 54 which correspond to the top tabs 50. Similarly, the bottom polymeric sheet 34 includes slits 56 which correspond to the bottom tabs 52. During assembly, once the plurality of lamellae 30 have been positioned within the longitudinal slots 36 of the grid housing 28, the top polymeric sheet 32 and the bottom polymeric sheet 34 are adhered to the grid housing 28. More particularly, the top polymeric sheet 32 is placed on to the grid housing 28 such that the upper tabs 50 of one of the plurality of lamellae 30 pass through one of the slits 54 in the top polymeric sheet 32. Likewise, the bottom polymeric sheet 34 is placed on the grid housing 28 such that the bottom tabs 52 of one of the plurality of lamellae 30 pass through one of the slits 56 in the bottom polymeric sheet 34. It should be emphasized that the tabs 50, 52 and the slits 54, 56 are utilized only in the preferred embodiment to assist in assembly and alignment of the radiographic grid 24. They are not required elements. In other words, the radiographic grid 24 will function without the tabs 50, 52 or the slits 54, 56.

The radiographic grid 24 shown in FIG. 2 is generally known in the prior art. While the radiographic grid 24 is quite functional, it still results in the undesirable lamellae line artifact previously described. The present invention overcomes this problem by providing an improved lamella 58 shown in FIG. 3. The lamella 58 includes a first side wall 60 and a second side wall 62. Additionally, the lamella 58 has a thin foil strip 64*a* applied to the first side wall 60 and a thin foil strip 64*b* applied to the second side wall 62.

The foil strips 64*a* and 64*b* can be made from a variety of elements, and are preferably tin. However, copper, lead, or any other metal or combination of metals which can be manufactured as a foil are equally acceptable substitutes. Whatever the composition of the foil strip 64*a* and 64*b*, it must be able to "block" the shadow density effect of the lamella 58. The thickness of the foil strip 64*a*, 64*b* will vary depending upon the type of material used. So long as the metal used is manufactured to industry standards as a "foil", the resulting thickness will be acceptable. Therefore, for example, where tin is used for the foil strip 64*a* and 64*b*, a thickness of 0.003 mm produced highly successful results.

The foil strip 64*a* or 64*b* can be pre-cut to a shape conforming to the lamella 58 and then attached to the appropriate side wall 60, 62 with an adhesive 65. In the preferred embodiment, the adhesive 65 is an acrylic based, pressure sensitive adhesive. However, other adhesives or forms of attaching the foil strips 64*a* or 64*b* to the lamella 58 are acceptable. For example, the foil strip 64*a*, 64*b* can be electrochemically coated on the first side wall 60 and the second side wall 62. Finally, a single piece of foil can be wrapped around the lamella 58.

Figure 3:
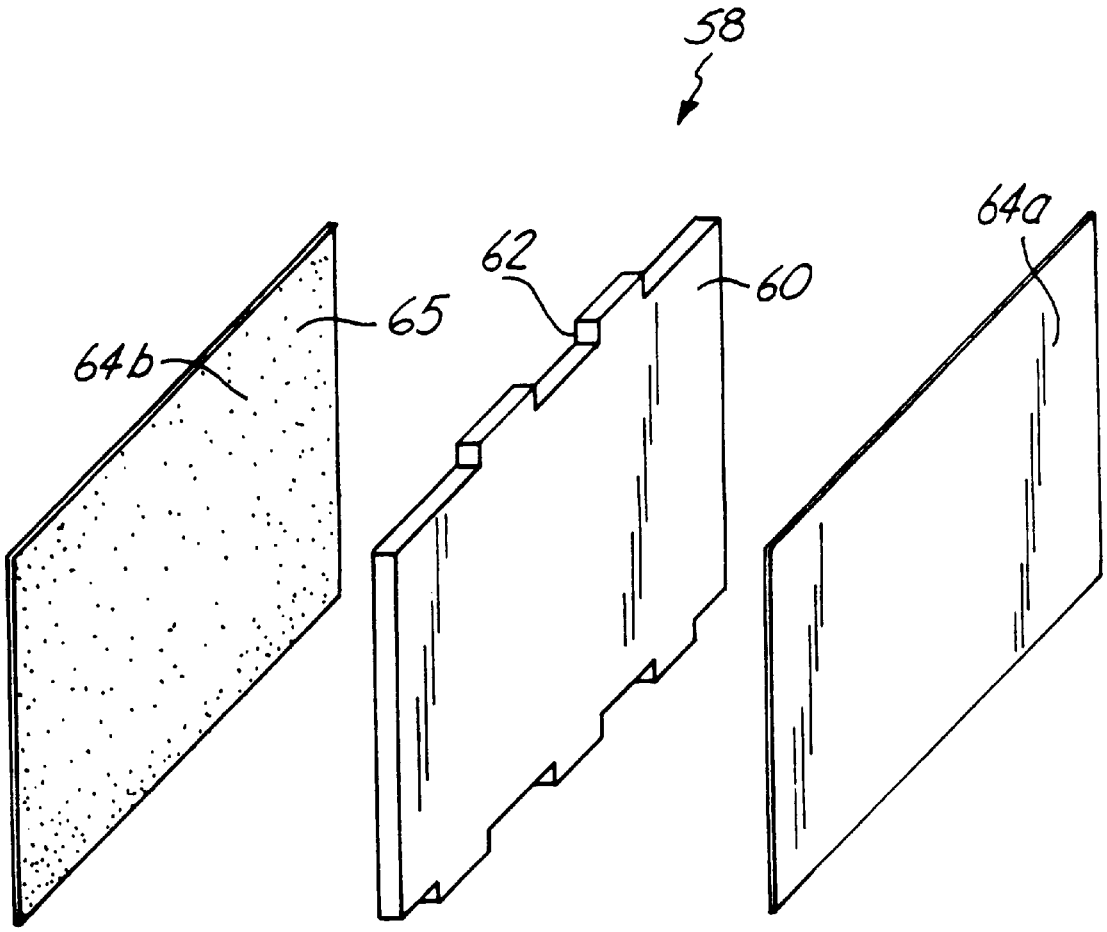
FIG. 3 is an exploded perspective view of a lamella coated with a thin metal foil in accordance with the present invention.
Figure 4A:
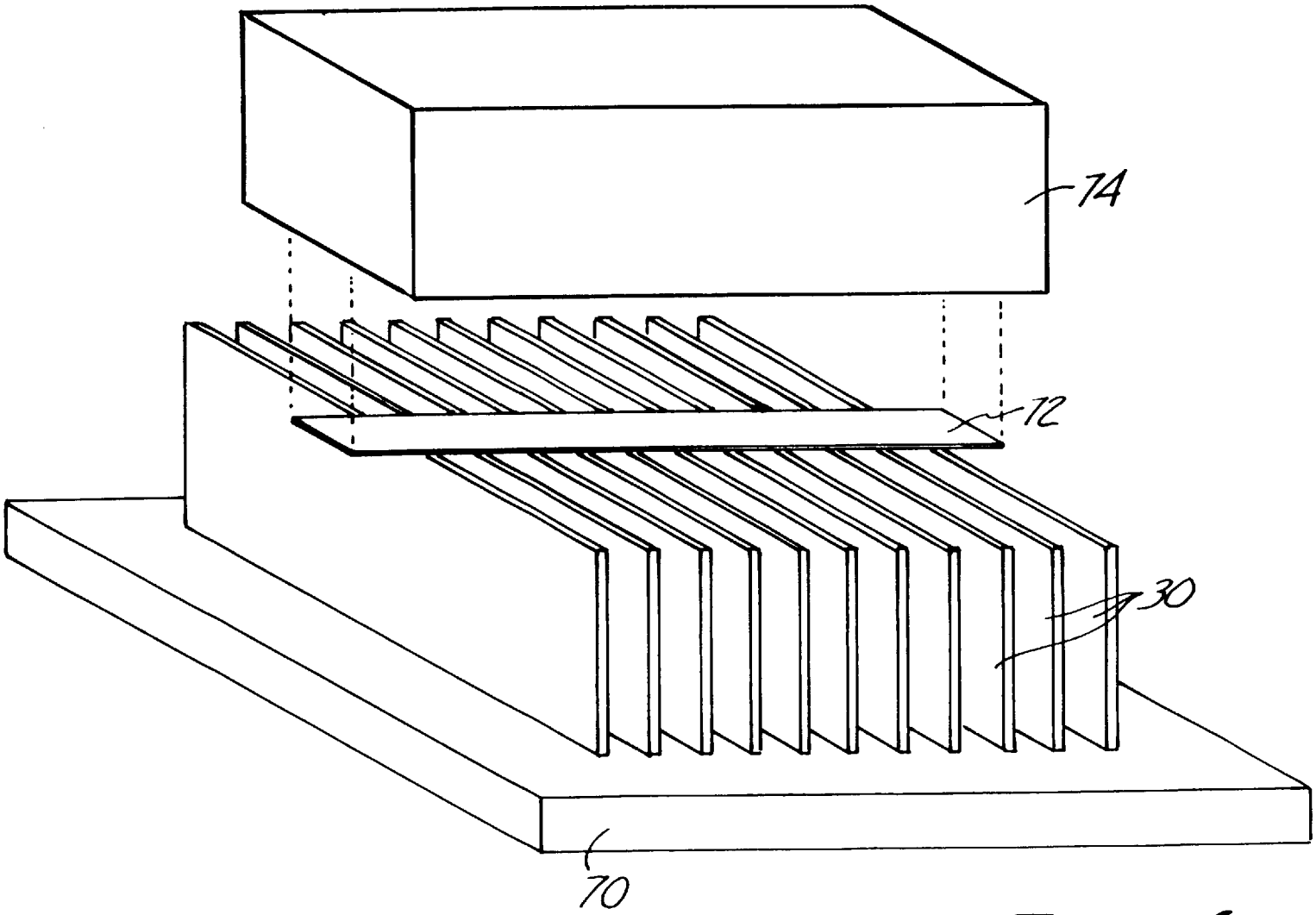
FIG. 4A is a perspective view of a test run with uncoated lamellae.

FIGS. 4A, 4B, 5A, 5B and 6 represent various tests and results of the foil strips 64*a* and 64*b* placed on the plurality of lamellae 30. FIG. 4A represents a first test performed with uncoated lamellae 30. In particular, a radiographic grid, including the plurality of lamellae 30 which were not coated with the foil strip (64*a* and 64*b* in FIG. 3), was placed on a film 70. Notably, the outer walls (28A–28D in FIG. 2) of the radiographic grid have been omitted from FIG. 4*a* to better show the test. A lead strip 72 was placed on top of the plurality of lamellae 30. A 4 cm piece of plastic 74, representing a human breast, was placed between an x-ray source (12 in FIG. 1 for example) and the radiographic grid. The x-ray source (12 in FIG. 1) was run at an energy radiation of 28 keV. Notably, mammographies are normally run at an energy radiation level in the range of 24–28 keV. During the test, the lead strip 72 blocked primary radiation from reaching the film 70 so as to better demonstrate the effects of the lamellae 30.

Figure 4B:
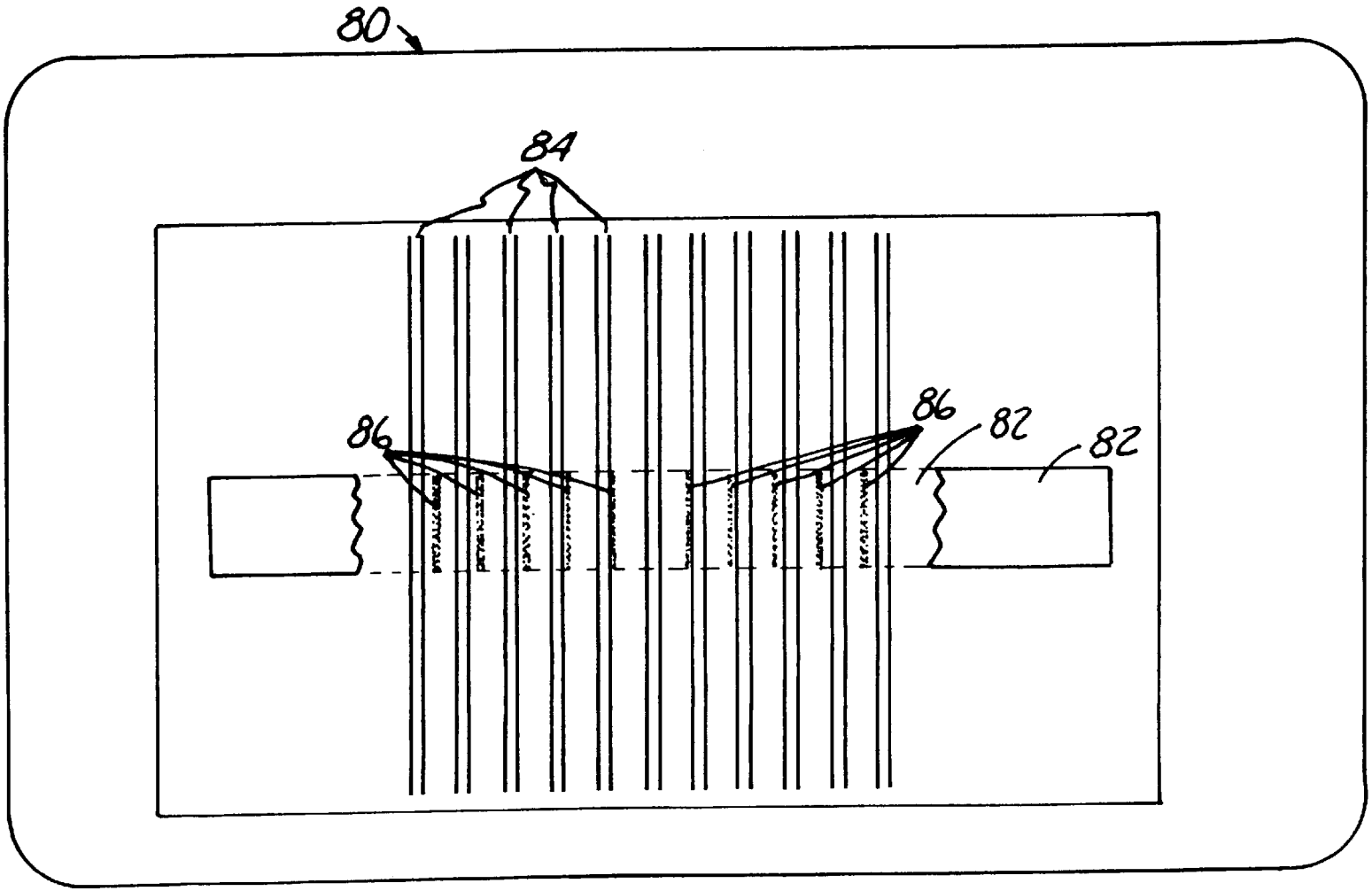
FIG. 4B is a representation of an x-ray image produced by the test shown in FIG. 4A using uncoated lamellae, including lamellae line artifacts.

FIG. 4B is a representation of an x-ray image 80 formed with the test described with reference to FIG. 4A. The image 80 depicts the strip of lead (72 in FIG. 4A) as an area of different density 82. Each of the plurality of lamellae (30 in FIG. 4A) also produced a definable image 84. Finally, each of the plurality of lamellae (30 in FIG. 4A) emitted line artifacts 86. These artifacts 86 appeared as shadows on the edges of the lamellae images 84. Between each lamella image 84, there is one artifact 86.

Figure 5A:
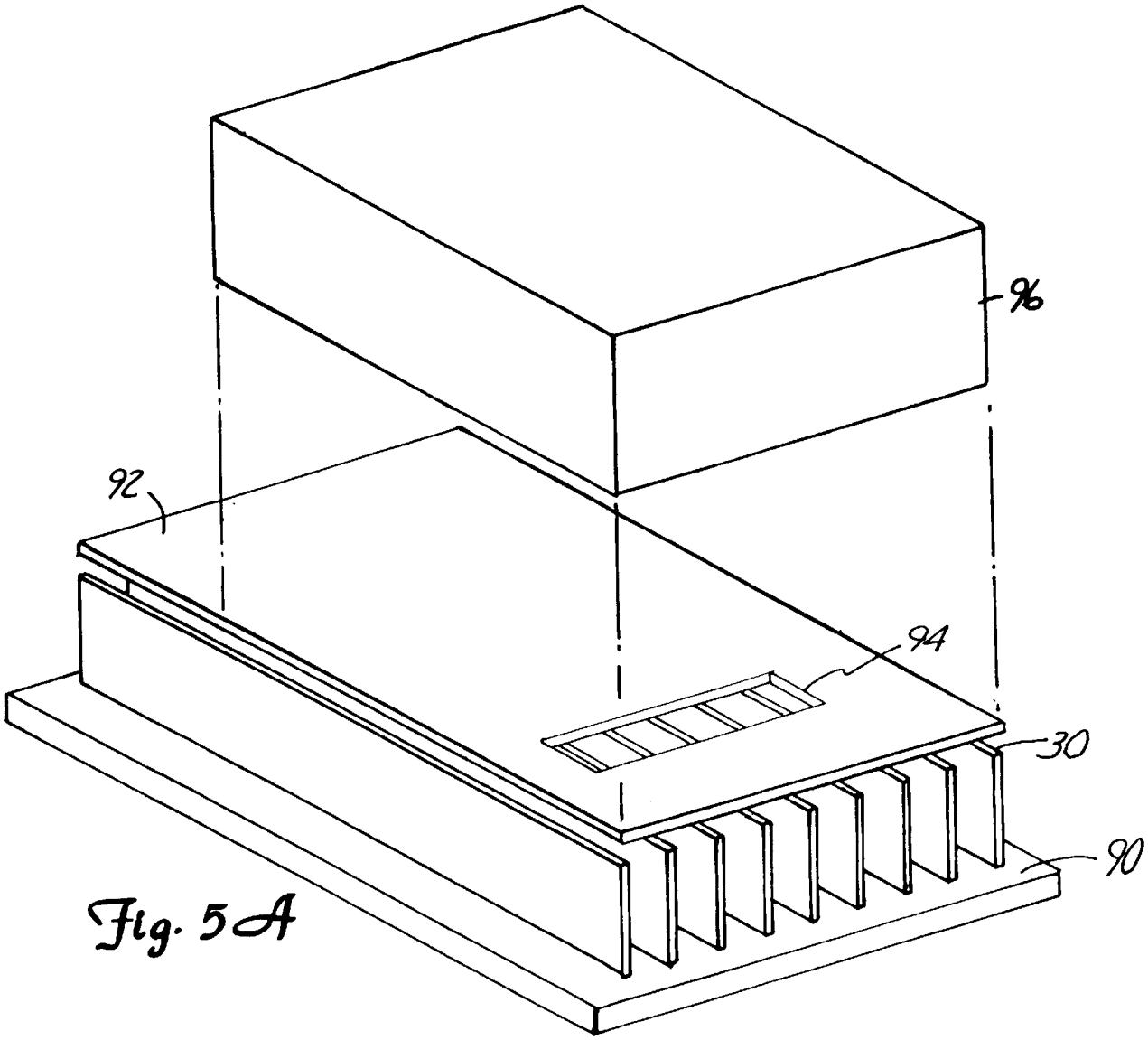
FIG. 5A is a perspective view of a second test run with uncoated lamellae.

FIG. 5A represents a second test performed with uncoated lamellae 30. Once again, a radiographic grid, including the plurality of lamellae 30 which were not coated with the foil strips (64*a* and 64*b* in FIG. 3), was placed on a film 90. The outer walls (28A–28D of FIG. 2) of the radiographic grid have been omitted to better show the test. A lead sheet 92 was placed on top of the plurality of lamellae 30. The lead sheet 92 included a rectangular opening 94. A piece of plastic 96, representing a human breast, was placed between an x-ray source (12 in FIG. 1 for example) and the radiographic grid. The x-ray source was run at an energy radiation of 28 keV. The rectangular opening 94 in the lead sheet 92 allowed primary radiation to pass through to the film 90.

Figure 5B:
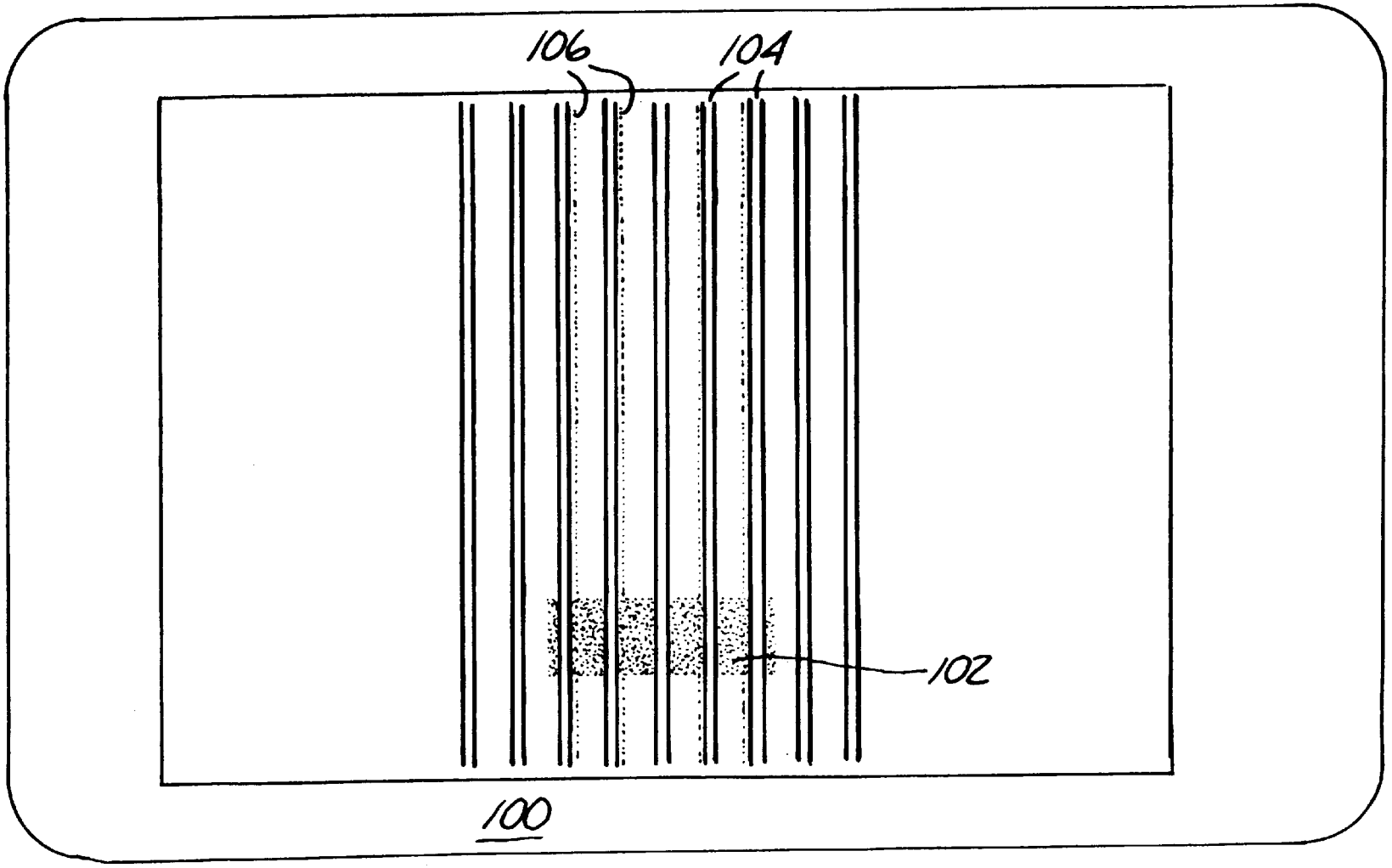
FIG. 5B is a representation of an x-ray image produced by the test shown in FIG. 5A using uncoated lamellae, including lamellae line artifacts.

FIG. 5B is a representation of an x-ray image 100 formed with the test described with reference to FIG. 5A. The rectangular opening (94 in FIG. 5A) produced a definable image 102. Similarly, the plurality of lamellae (30 in FIG. 5A) produced definable images 104. Finally, several of the plurality of lamellae (30 in FIG. 5A) emitted line artifacts 106. As expected, no line artifacts were produced by the plurality of lamellae (30 in FIG. 5A) not aligned with the rectangular opening (94 in FIG. 5A). Notably, the line artifacts 106 extended far beyond the rectangular opening image 102. Thus, the line artifacts 106 appear to be carefully transmitted to extend beyond an expected angle of acceptance. In other words, as x-rays pass through the piece of plastic (96 in FIG. 5A), scattering takes place. The x-ray source (12 in FIG. 1) produces x-rays which pass into the piece of plastic (96 in FIG. 5A). The scatter resulting from the primary rays striking the plastic at an angle leaves the piece of plastic (96 in FIG. 5A) at a resulting angle of acceptance. Some of these scattered x-rays pass through the rectangular opening (94 in FIG. 5A) and then contact the plurality of lamellae (30 in FIG. 5*a*) aligned with the rectangular opening (94 in FIG. 5A) at an angle. Thus, the resulting lamellae line artifacts 106 do not terminate at the angle of acceptance of the rectangular opening (96 in FIG. 5A), but instead extend "beyond" the image 102.

Figure 6:
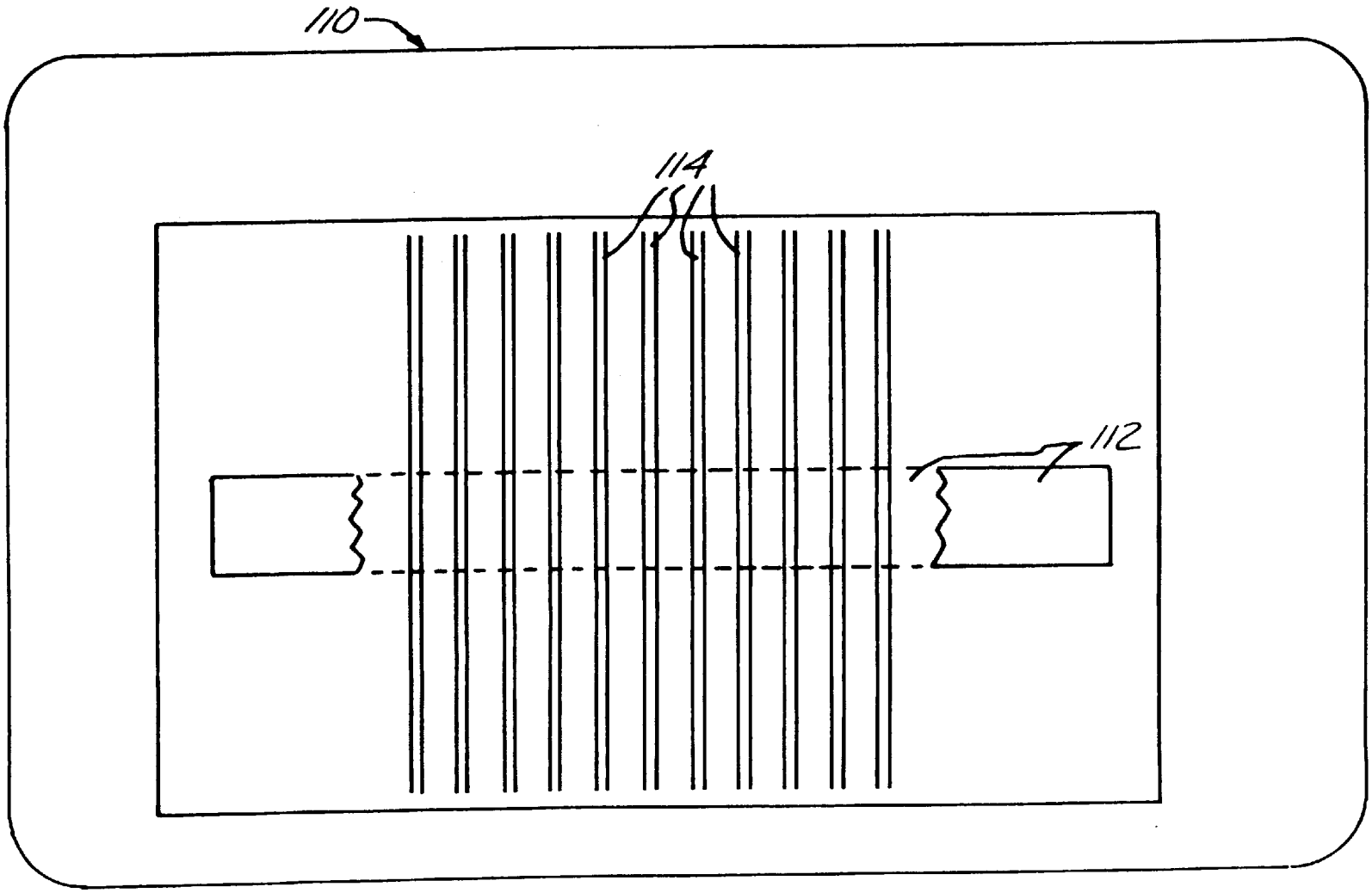
FIG. 6 is a representation of an x-ray image produced by a radiographic grid of the present invention.

FIG. 6 is a representation of an x-ray image 110 formed with a radiographic grid having the plurality of lamellae (30 in FIG. 2) lined with a tin foil (shown in FIG. 3 as 64*a*, 64*b*). Similar to the test shown in FIG. 4A, a strip of lead (72 in FIG. 4A) was placed across the radiographic grid prior to activating the x-ray source. The strip of lead (72 in FIG. 4A) produced a definable image 112. Similarly, the plurality of lamellae (30 in FIG. 2) produced a definable image 114. However, as is shown in FIG. 6, the lamellae line artifacts are no longer present. Thus, the foil (64*a*, 64*b* in FIG. 3) eliminated the unilateral, well-defined density emanating from the plurality of lamellae.

Numerous tests have produced consistent results. For example, foil comprised of tin, copper or lead all eliminated the lamellae line artifacts from the x-ray image. Further tests, similar to those described with respect to FIG. 6, were performed with a foil coating on only one of the lamella. This approach did not eliminate the line density artifact. Thus, the complete elimination of the lamellae line artifact appears to depend upon coating both adjacent lamellae with foil strips. However, coating only a single lamella with foil strips will still reduce the line density artifact.

The radiographic grid of the present invention provides a significant improvement over past grids. By applying a foil coating to the side walls of the lamellae, the lamella line artifacts are eliminated. As a result, a more accurate x-ray image is produced.

FIG. 7 and 8 show another embodiment of the present invention, which is based upon the surprising discovery that a foil (or coating) on lower end portions of each lamella is effective in eliminating the lamellae line artifacts from the x-ray image.

As shown in FIG. 7, lamella 58' has foil 64' covering its lower or bottom end portion. Foil 64' covers a small portion of each side of lamella 58', as well as the bottom edges of lamella 58'. Tabs 52' are also covered by the foil.

It has been found that using foil only on the bottom portions of each lamella (as opposed to covering both sides entirely) achieves the same elimination of line density artifacts. The embodiment shown in FIGS. 7 and 8 offers the further advantage of using far less foil. As in the previous embodiment shown in FIG. 3, foil 64' can be attached by adhesive or can be formed by coating processes, such as electrochemical coating.

When the distance between the lamellae is decreased to less than 2 mm the linear artifact becomes a solid density in the interspaces. This density may or may not be present in the particular interspace. There is no pattern; it may alternate. The energy that produces this effect appears to be equilibrated and related to the variance in the interspace. By analogy, immersing a varied interspace grid partway into a fluid with standing wave vibrations would induce a wave in some but not all interspaces depending on the spacing and frequency of the wave. The application of the foil as described above will eliminate this density.

Although the present invention has been described with reference to preferred embodiments, workers skilled in the art will recognize that changes may be made in form and detail without departing from the spirit and scope of the invention. For example, the radiographic grid has been described as including lamellae with tabs. However, these tabs are not required. Further, the use of foil coated lamellae has other applications with radiographic grids. For example, the grid can be used with digital radiography.

What is claimed is:

1. A radiographic grid comprising:

a grid housing; and a plurality of x-ray radiation absorbing lamellae maintained within a grid housing and defining slots therebetween, wherein each of the plurality of lamellae has a thickness of about 0.075 mm to about 0.25 mm and a height of about 3 mm to about 20 mm and has a first side wall and a second side wall, wherein a ratio of height of the lamellae to distance between adjacent lamellae is at least about 5:1, wherein no lamella contacts any other lamella, and further wherein a metal foil is not attached to an upper portion of the first and second side walls, wherein a metal foil is attached to a lower portion of the first and second side walls, and wherein a metal foil is attached to a bottom surface adjacent the lower portion of one of the plurality of lamellae for reducing lamella emitted line artifacts.

2. The radiographic grid of claim 1 wherein the metal foil is tin.

3. The radiographic grid of claim 1 wherein the metal foil is electrochemically coated on to the lower portions of the lamella.

4. An improved radiographic grid comprising a grid housing having a first and a second side wall, and a plurality of x-ray radiation absorbing lamellae disposed between the first and second side walls of the grid housing and defining slots between adjacent lamellae, wherein no lamella contacts any other lamella wherein each of the lamellae has a thickness of about 0.075 mm to about 0.25 mm and a height of about 3 mm to about 20 mm, and wherein a ratio of height of the lamellae to distance between adjacent lamellae is at least about 5:1, the improvement comprising:

metal foil on lower portions and not on upper portions of the plurality of lamellae, the lower portions being furthest from an x-ray source, for reducing line density artifacts, the metal foil covering a bottom surface of the lower portions.

* * * * *